US012114752B2

(12) United States Patent
Lin

(10) Patent No.: US 12,114,752 B2
(45) Date of Patent: Oct. 15, 2024

(54) CONTAINER WITH A DETACHABLE MIRROR

(71) Applicant: LIBO COSMETICS CO., LTD., Taichung (TW)

(72) Inventor: Hsiao-Yun Lin, Taichung (TW)

( * ) Notice: Subject to any disclaimer, the term of this patent is extended or adjusted under 35 U.S.C. 154(b) by 259 days.

(21) Appl. No.: 17/853,932

(22) Filed: Jun. 30, 2022

(65) Prior Publication Data

US 2024/0000212 A1 Jan. 4, 2024

(51) Int. Cl.
*A45D 33/00* (2006.01)

(52) U.S. Cl.
CPC ..... *A45D 33/008* (2013.01)

(58) Field of Classification Search
CPC .... A45D 33/00; A45D 33/006; A45D 33/008; A45D 33/20; A45D 33/22; A45D 33/24; A45D 33/26; A45D 33/28; A45D 40/00; A45D 40/24; A45D 40/04; A45D 40/22; A45D 40/221; A45D 40/222; A45D 2040/223; A45D 2040/225; A45D 2040/226; A45D 2040/227; A45D 2040/228; A45D 42/00; A45D 42/02; A45D 42/04; A45D 42/08; A45D 42/10; A45D 42/16; A45D 42/20
USPC ..... 132/291, 296, 301, 302, 304; 362/136, 362/139, 141, 142, 492
See application file for complete search history.

(56) References Cited

U.S. PATENT DOCUMENTS 5,054,505 A * 10/1991 Yuhara ..... A45D 40/18 132/304
2005/0194021 A1* 9/2005 Byun ..... A45D 40/18 132/295
2006/0077654 A1* 4/2006 Krieger ..... A45D 42/04 362/183
2009/0255846 A1* 10/2009 Pires ..... A45C 5/005 206/581
2017/0265622 A1* 9/2017 Eberlein ..... A45D 40/22
2019/0374007 A1* 12/2019 Kaiser ..... A45D 42/10
2020/0146424 A1* 5/2020 Edgemon ..... A45D 40/24
2021/0022480 A1* 1/2021 Sobol ..... A45D 40/24
2021/0259387 A1* 8/2021 Salas ..... A45D 33/22
2022/0031046 A1* 2/2022 Sobol ..... A45D 40/22
2022/0117378 A1* 4/2022 Plain ..... A45D 40/24

FOREIGN PATENT DOCUMENTS

FR 3093279 A1 * 9/2020 ..... A45D 33/20

OTHER PUBLICATIONS

FR 3093279 A1. Translation (Year: 2020).*

* cited by examiner

*Primary Examiner* — Cris L. Rodriguez
*Assistant Examiner* — Karim Asqiriba
(74) *Attorney, Agent, or Firm* — Bruce Stone LLP; Joseph A. Bruce

(57) ABSTRACT

A container includes a lid, a frame, and a mirror. The lid includes two external ridges and at least one intermediate ridge formed on a face thereof. The intermediate ridge is located between and in parallel to the external ridges. A height of the intermediate ridge is smaller than a height of the external ridges. The frame includes fins extending from a face thereof. The fins are in parallel to one another. During attachment of the frame to the lid, the fins are slidable on the intermediate and external ridges to render movement of the frame on the lid smooth like swinging of a pendulum. The mirror is attached to an opposite face of the frame.

5 Claims, 6 Drawing Sheets

CONTAINER WITH A DETACHABLE MIRROR

BACKGROUND OF INVENTION

1. Field of Invention

The present invention relates to a container for cosmetics and, more particularly, to a container with a detachable mirror.

2. Related Prior Art

A container for cosmetics often includes a mirror. Thus, while using the cosmetics, a user is allowed to observe her or his face in the mirror to facilitate her or him to use the cosmetics on her or his face properly.

The container is made of recyclable plastics. Hence, the container can be recycled after running out of the cosmetics. However, the mirror is made of unrecyclable materials, and it requires unrecyclable materials to attach the mirror to the container. Hence, the mirror inevitably causes an environmental problem.

The present invention is therefore intended to obviate or at least alleviate the problems encountered in the prior art.

SUMMARY OF INVENTION

It is the primary objective of the present invention to provide an environmentally friendly container with a detachable mirror.

To achieve the foregoing objective, the container includes a lid, a frame, and a mirror. The lid includes two external ridges and at least one intermediate ridge formed on a face thereof. The intermediate ridge is located between and in parallel to the external ridges. A height of the intermediate ridge is smaller than a height of the external ridges. The frame includes fins extending from a face thereof. The fins are in parallel to one another. During attachment of the frame to the lid, the fins are slidable on the intermediate and external ridges to render movement of the frame on the lid smooth like swinging of a pendulum. The mirror is attached to an opposite face of the frame.

Other objectives, advantages and features of the present invention will be apparent from the following description referring to the attached drawings.

BRIEF DESCRIPTION OF DRAWINGS has been amended as follows:

The present invention will be described via detailed illustration of the preferred embodiment referring to the drawings wherein.

DETAILED DESCRIPTION OF PREFERRED EMBODIMENT

Figure 1:
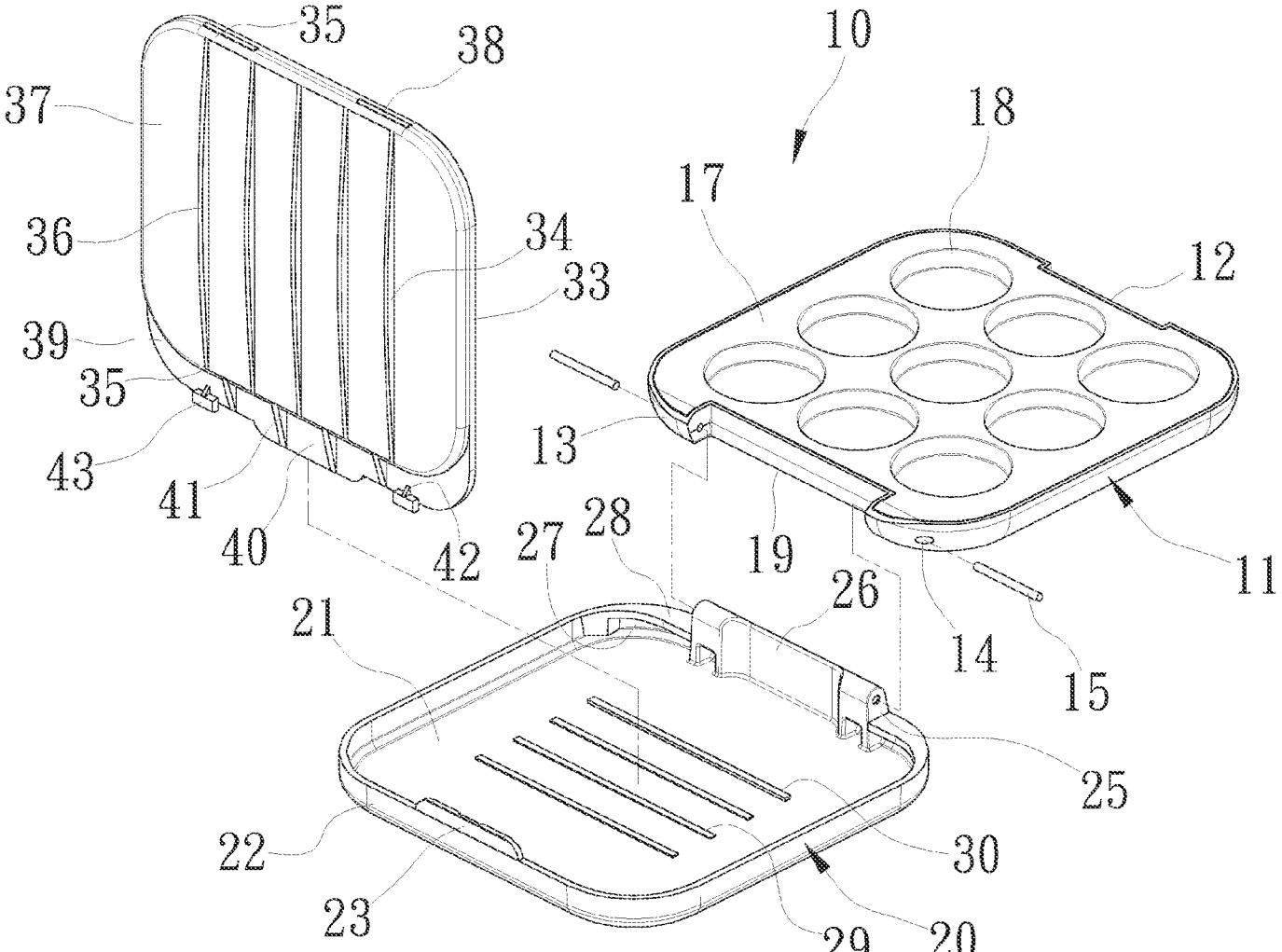
FIG. 1 is an exploded view of a container with a detachable mirror according to the preferred embodiment of the present invention.
Figure 2:
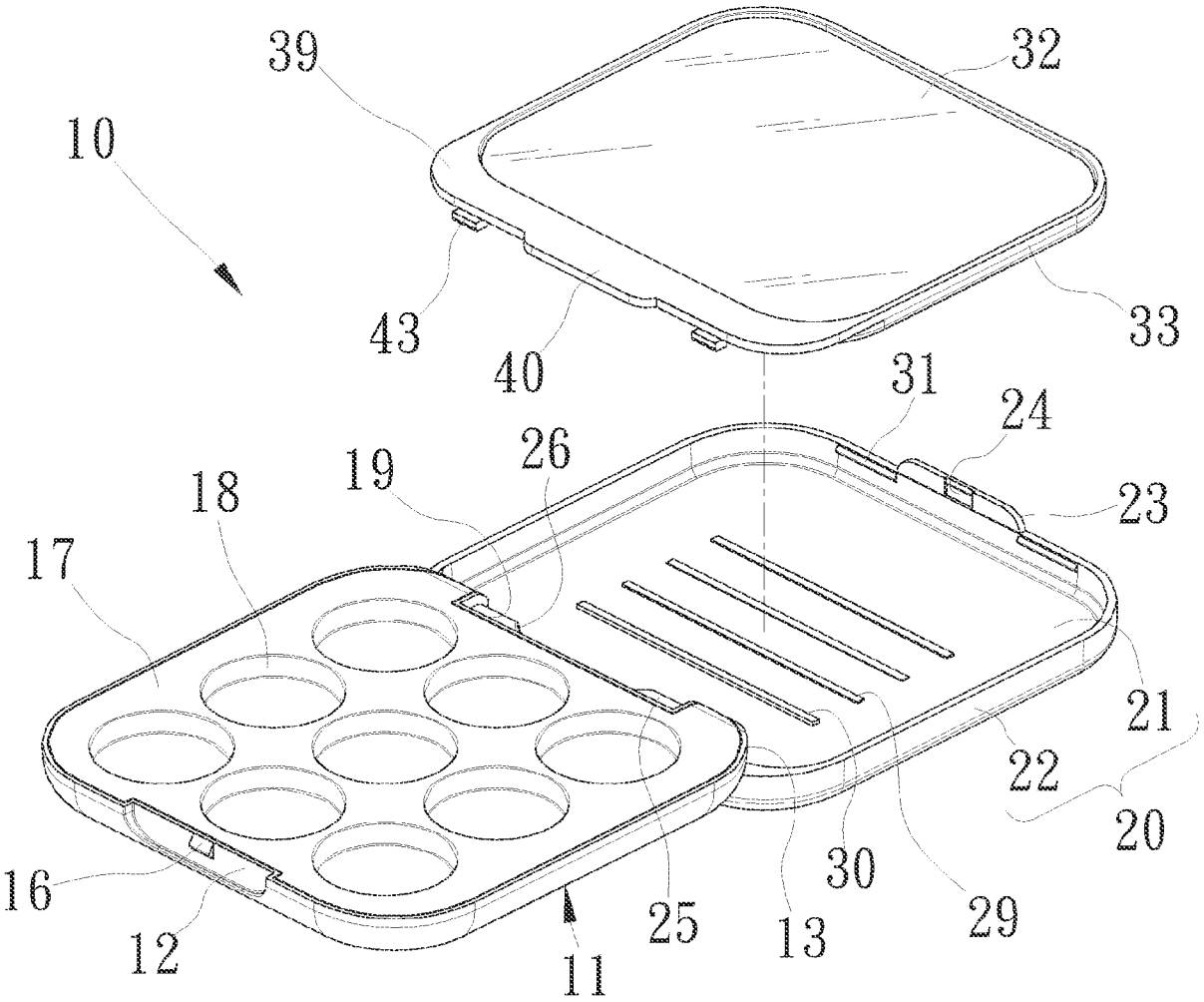
FIG. 2 is another exploded view of the container and the detachable mirror shown in FIG. 1.

Referring to FIGS. 1 and 2, a container 10 includes a box 11, a palette 17 fitted in the box 11, a lid 20 pivotally connected to the box 11, a frame 33 connected to the lid 20 in a detachable manner, and a mirror 32 connected to the frame 33 according to the preferred embodiment of the present invention. The container 10 is operable for containing cosmetics for example.

The box 11 and the lid 20 are made of post-consumer recycled plastics ("PCRP") so that they can be post-consumer recycled ("PCR"). The box 11 and the lid 20 can be made of other recyclable materials.

The box 11 includes a bottom (not numbered) and four walls (not numbered). The bottom of the box 11 is preferably rectangular. The walls of the box 11 extend around the bottom of the box 11. A recess 12 is made in a front one of the walls of the box 11. A barb 16 extends from the front wall of the box 11. Preferably, the barb 16 is located within the recess 12. Two lugs 13 extends from a rear one of the walls of the box 11 opposite to the front wall of the box 11. Each of the lugs 13 includes an orifice 14. A recess 19 is made between the lugs 13.

The palette 17 is also made of PCRP preferably. The palette 17 can be detached from the box 11 and recycled. The palette 17 is shaped in compliance with the box 11 so that the palette 17 can be fitted in the box 11. The palette 17 includes bores 18 in an upper face thereof. Each of the bores 18 is intended to receive a cosmetic product in a color. Hence, the bores 18 receives cosmetic products in various colors.

Preferably, the bores 18 are circular. However, each of the bores 18 can be in another proper shape to receive a cosmetic tool such as a puff, an eyeshadow pencil, and a cosmetic brush.

The lid 20 includes a top 21 and four walls 22. The top 21 is preferably rectangular. The walls 22 extend around the top 21. The profile of the lid 20 is substantially identical to the profile of the box 11. A lock 23 is formed on one of the walls 22. A barb 24 is formed on an intermediate face of the lock 23. A lug 25 extends from an opposite one of the walls 22. The lug 25 faces the lock 23. The lug 25 includes two orifices (not numbered) in two opposite ends.

The lug 25 is inserted in the recess 19 so that each of the ends of the lug 25 is in contact with a corresponding one of the lugs 13. A pin 15 is inserted in the orifice 14 of each of the lugs 13 and a corresponding one of the orifices of the lug 25, thereby pivotally connecting the lid 20 to the box 11. The lid 20 is movable relative to the box 11 between an opening position and a closing position.

In the closing position, the lid 20 is in parallel to the box 11 so that the lid 20 covers the bores 18 of the palette 17, which is inserted in the box 11. Now, the recess 12 receives the lock 23, and the barb 16 is engaged with the barb 24, thereby keeping the lid 20 in the closing position relative to the box 11.

The lock 23 is removable from the recess 12, i.e., the barb 16 is disengaged from the barb 24, thereby allowing the lid 20 to move to the opening position relative to the lid 20. Now, the bores 18 are exposed.

The lid 20 further includes a recess 26 and two bores 27. The recess 26 is made in the lug 25. The recess 26 renders the lug 25 U-shaped in a top view of the lid 20 in the opening position. The recess 26 faces the lock 23.

Two shielding portions 28 extend from the lug 25 in opposite directions so that each of the shielding portions 28 and the front wall 22 together provide a bore 27. That is, the bores 27 are located on opposite sides of the lug 25.

The top 21 is formed with two intermediate ridges 29 between two external ridges 30. The ridges 29 and 30 are located between the front and rear walls 22. The ridges 29 and 30 are in parallel to one another. The height of the intermediate ridges 29 is smaller than the height of the external ridges 30.

Two elongated protuberances 31 extend from the rear wall 22 toward the bores 27. The elongated protuberances 31 are on opposite sides of the lock 23.

The frame 33 is made of PCRP. The frame 33 is shaped in compliance with the lid 20.

The mirror 32 is attached to a front face of the frame 33 by adhesion for example. Preferably, the frame 33 includes, in the front face, a cavity (not numbered) for receiving the mirror 32. The frame 33 can be in any proper shape as along as it can receive the mirror 32. Thus, the frame 33 protects the mirror 32.

Fins 34 extend on a rear face 37 of the frame 33 opposite to the front face of the frame 33. Each of the fins 34 includes two lower portions 35 at two ends and an apex 36 in the middle. Thus, each of the fins 34 includes an arched edge.

Two elongated protuberances 38 extend from a rear edge (not numbered) of the frame 33.

A flange 39 extends from a front edge (not numbered) of the frame 33 opposite to the rear edge of the frame 33. The flange 39 includes an indicating portion 40 in the middle of a front edge of the flange 39.

Several reinforcement portions 41 extend on a rear face of the flange 39 from the front edge of the frame 33 to enhance the strength of the flange 39. Preferably, two of the reinforcement portions 41 extend on a rear face of the indicating portion 40 to enhance the strength of the indicating portion 40.

Two extensive portions 43 are formed on the rear face of the flange 39. The extensive portions 43 are in parallel to the flange 39, with the former extending beyond the latter. Two supporting portions 42 extend on the rear face of the flange 39. Each of the supporting portions 42 is formed at a corner between a corresponding one of the extensive portions 43 and the flange 39 to reinforce the strength of the related extensive portion 43.

Figure 3:
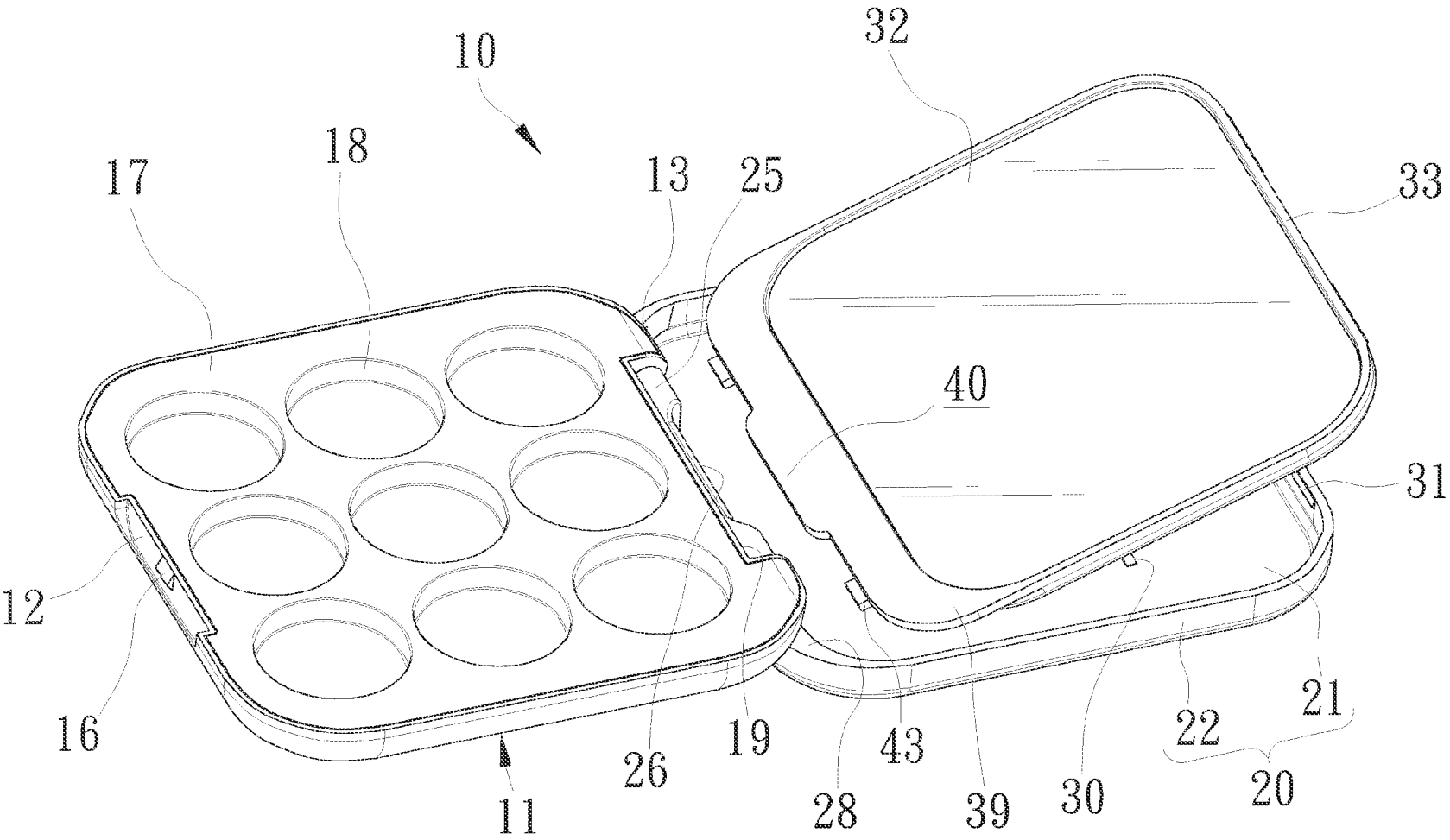
FIG. 3 is a perspective view of the container and the detachable mirror shown in FIG. 1.

Referring to FIG. 3, the container 10 is fully opened when the top 21 of the lid 20 is in parallel to the bottom of the box 11. The frame 33 is tilted, with the flange 39 pointed downward and the elongated protuberances 38 (FIG. 1) pointed upward. The indicating portion 40 is aligned to the recess 26 of the lug 25. Now, the mirror 32 faces up.

Figure 4:
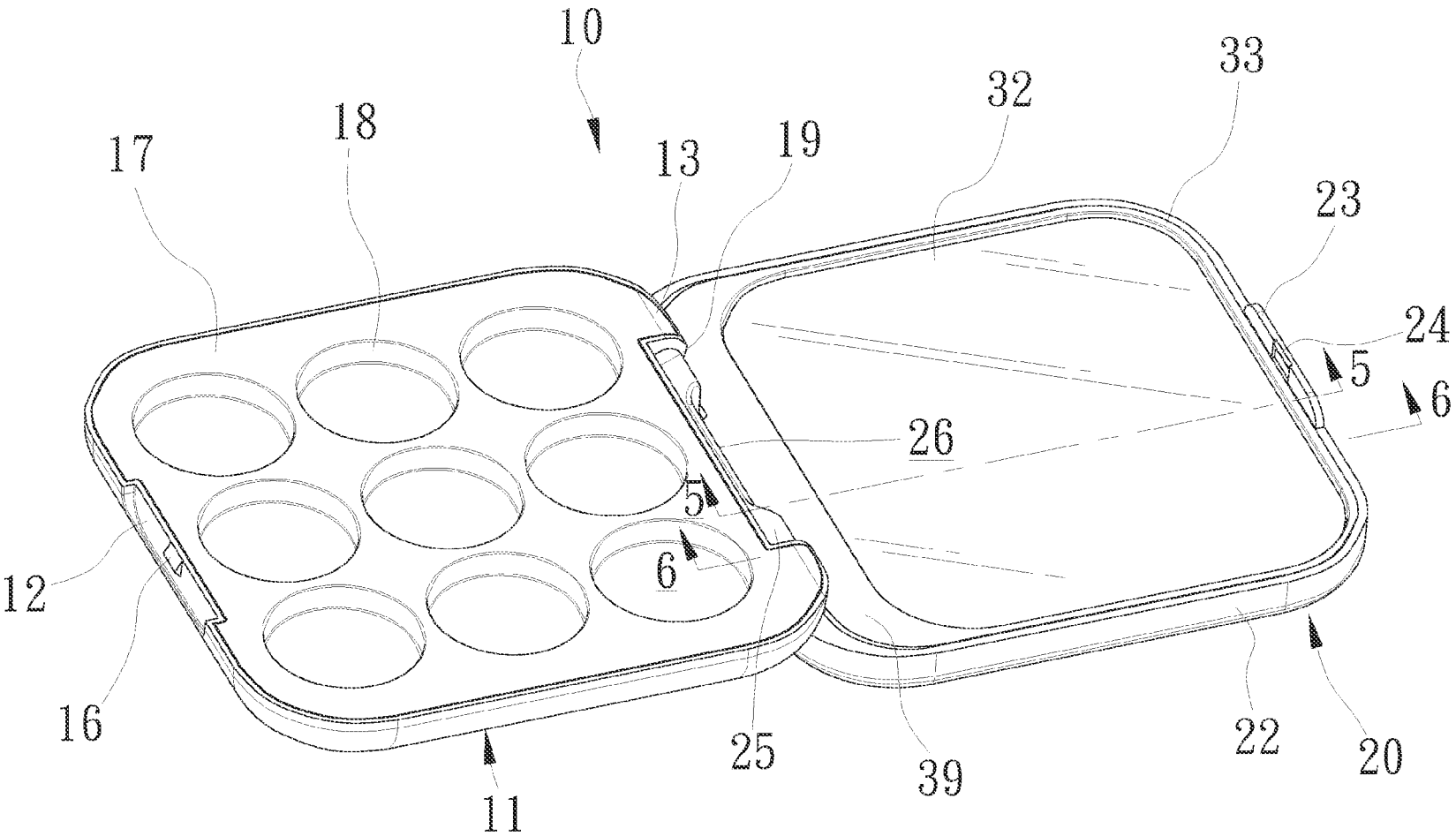
FIG. 4 is a perspective view of the container and the detachable mirror in another position than shown in FIG. 3.
Figure 5:
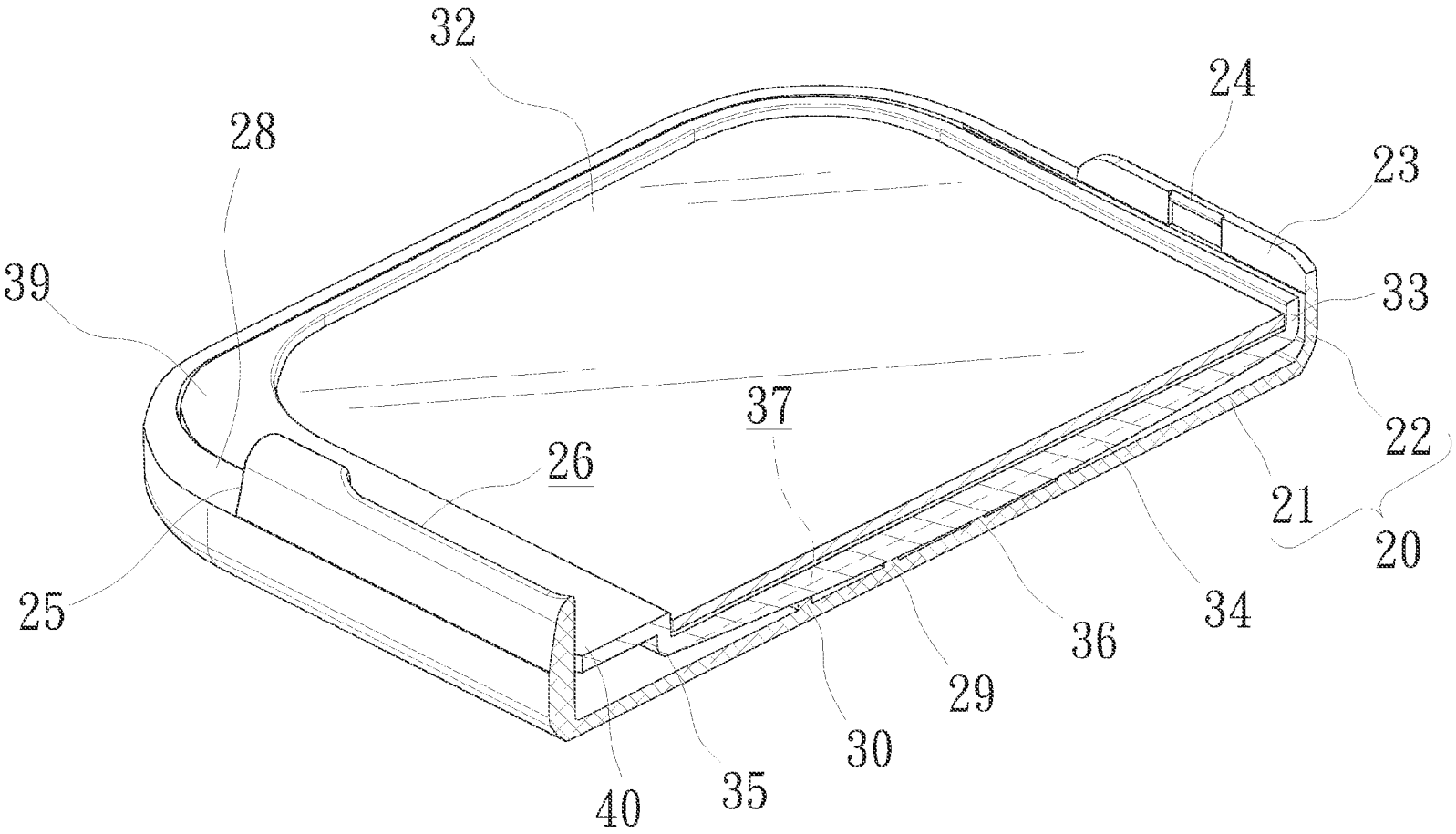
FIG. 5 is a cut-away view of the container and the detachable mirror taken along a line 5-5 shown in FIG. 4.

Referring to FIGS. 4 and 5, the frame 33 is translated toward the lug 25 to bring the flange 39 into contact with the lug 25 and the shielding portions 28. Thus, the indicating portion 40 is inserted in the recess 26 and the extensive portions 43 are inserted in the bores 27. Then, the frame 33 is pivoted downward and laid on the lid 20.

Figure 6:
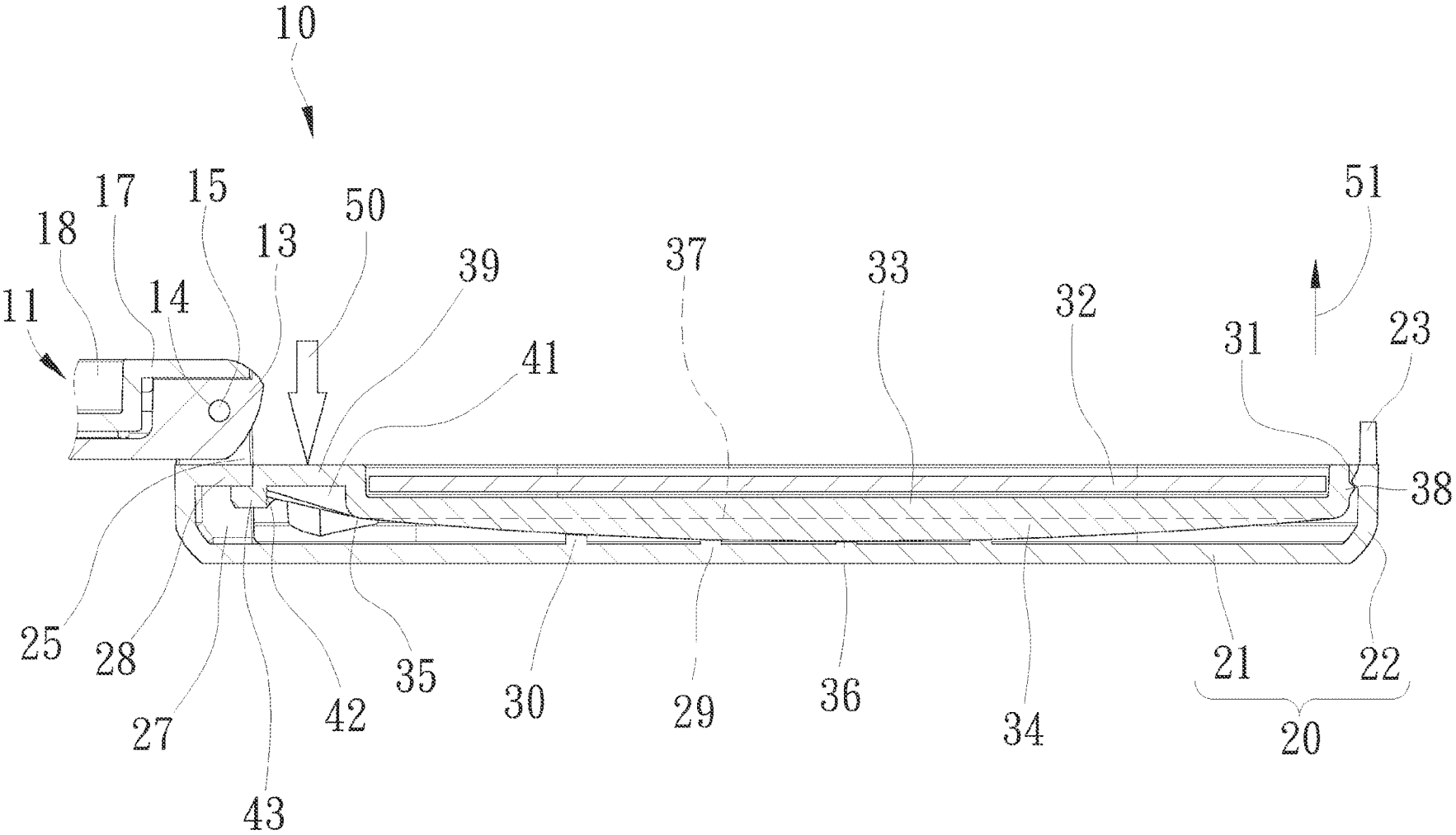
FIG. 6 is a cross-sectional view of the container and the detachable mirror taken along a line 6-6 shown in FIG. 4.

Referring to FIG. 6, the fins 34 are in contact with the ridges 29 and 30. That is, the frame 33 is not in contact with the top 21 except for the fins 34 in contact with the ridges 29 and 30. The fins 34 intersect the ridges 29 and 30. The extensive portions 43 of the frame 33 are engaged with the shielding portions 28 of the lid 20. The elongated protuberances 38 of the frame 33 are engaged with the elongated protuberances 31, which extend on the wall 22 of the lid 20. Thus, the frame 33 is retained on or in the lid 20. Hence, the mirror 32 is retained on or in the lid 20. A front or upper face of the flange 39 is in a same plane with a front or upper face of each of the shielding portions 28 so that a front or upper face of the mirror 32 is in a same plane with edges (not numbered) of the walls 22 of the lid 20.

To detach the combination of the mirror 32 with the frame 33 from the lid 20, a force indicated by an arrow head 50 is exerted on the flange 39 to pivot the frame 33 upward from the lid 20, thereby lifting the rear edge of the frame 33 from the lid 20 as indicated with an arrow head 51. The elongated protuberances 38 are disengaged from the elongated protuberances 31 to allow detachment of the combination of the mirror 32 with the frame 33 from the lid 20.

Referring to FIG. 3, the frame 33 is returned to the tilted position where the extensive portions 43 are moved out of the bores 27 (FIG. 6). That is, the combination of the mirror 32 with the frame 33 is detached from the lid 20. Now, the mirror 32 can be detached from the frame 33 and recycled or disposed of. As mentioned above, the frame 33 can be recycled, and so are the box 11, the palette 17 and the lid 20.

Referring to FIGS. 3 and 6, the container 10 exhibits several advantageous features.

Firstly, the intermediate ridges 29 are different from the external ridges 30 in height to provide an arched path in compliance with the edge of each of the fins 34, which includes the lower portions 35 and the apex 36. Hence, the frame 33 is smoothly movable into the flat position from the titled position like swinging of a pendulum, i.e., the frame 33 is smoothly attached to the lid 20.

Secondly, the total area of the fins 34 in contact with the ridges 29 and 30 is small. Hence, the friction between the fins 34 and the ridges 29 and 30 is small. Thus, the frame 33 is smoothly movable on the lid 20.

Thirdly, the contact of the extensive portions 43 with the shielding portions 28 means an end of the movement of the frame 33 on the lid 20. That is, the positioning of the combination of the mirror 32 with the frame 33 relative to the lid 20 is fast.

Fourthly, the upper faces of the shielding portions 28 are in the same plane with the flange 39 and the extensive portions 43 are concealed in the bores 27. The look of the container 10 is neat.

Fifthly, the engagement of the elongated protuberances 31 with the elongated protuberances 38 is easy and adequate to keep the frame 33 on or in the lid 20.

Sixthly, the insertion of the indicating portion 40 in the recess 26 is a fool-proof design to ensure proper attachment of the frame 33 to the lid 20.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A container comprising:

a lid comprising two external ridges and an intermediate ridge formed on a face thereof, wherein the intermediate ridge is located between and in parallel to the external ridges;

a frame comprising fins extending from a face thereof, wherein the fins are in parallel to one another, wherein during attachment of the frame to the lid, the fins are slidable on the intermediate and external ridges to render movement of the frame on the lid smooth, wherein each of the fins comprises an arched edge comprising an apex and two lower portions, and wherein a height of the intermediate ridge is smaller than a height of the external ridges so that the intermediate and external ridges provide an arched path in compliance with the edges of the fins; and a mirror attached to an opposite face of the frame.

2. The container according to claim 1, wherein the fins intersect the intermediate and external ridges.

3. The container according to claim 1, wherein the lid comprises a first wall and two shielding portions extending from the first wall so that the first wall and each of the shielding portions together provide a bore, wherein the frame comprises a first edge and two extensive portions extending from the first edge, and wherein the extensive portions are inserted in the bores and shielded by the shielding portions when the frame is properly attached to the lid.

4. The container according to claim 3, wherein the lid comprises a second wall located opposite to the first wall and an elongated protuberance extending from the second wall, wherein the frame comprises a second edge located opposite to the first edge and an elongated protuberance extending from the second edge, and wherein the elongated protuberance of the frame are engageable with the elongated protuberance of the lid to keep the frame on the lid.

5. The container according to claim 1, wherein the lid comprises a recess in the wall, and wherein the frame comprises an indicating portion insertable in the recess to precisely position the frame relative to the lid.

* * * * *